US006532670B1

(12) United States Patent
Berns

(10) Patent No.: US 6,532,670 B1
(45) Date of Patent: Mar. 18, 2003

(54) UTILITY KNIFE WITH SCREW-DOWN PIVOTAL BLADE CLAMP

(75) Inventor: Harald Berns, Wuppertal (DE)

(73) Assignee: Martor-Argentax E.H. Beermann KG, Solingen (DE)

( * ) Notice: Subject to any disclaimer, the term of this patent is extended or adjusted under 35 U.S.C. 154(b) by 0 days.

(21) Appl. No.: 09/718,436

(22) Filed: Nov. 22, 2000

(30) Foreign Application Priority Data

Dec. 10, 1999 (DE) ..... 199 59 874

(51) Int. Cl.[7] ..... B26B 5/00

(52) U.S. Cl. ..... 30/339; 30/330; 30/332; 30/338; 30/2

(58) Field of Search ..... 60/156, 162, 2, 60/330, 331, 332, 329, 317, 334, 337, 342, 339, 338, 125

(56) References Cited

U.S. PATENT DOCUMENTS

| | | | | | |
|---|---|---|---|---|---|
| 2,187,590 A | * | 1/1940 | Lurie | | 30/2 |
| 3,184,843 A | * | 5/1965 | Lurie | | 30/2 |
| 3,509,627 A | * | 5/1970 | Gilbert et al. | | 30/125 |
| 3,660,895 A | | 5/1972 | West | | |
| 3,927,473 A | * | 12/1975 | Braginetz | | 30/125 |
| 4,575,940 A | * | 3/1986 | Wenzel | | 30/335 |
| 5,797,188 A | | 8/1998 | Gilbert | | |
| 5,864,954 A | * | 2/1999 | Harrington | | 30/162 |
| 5,940,970 A | | 8/1999 | D'Ambro, Sr. et al. | | |

FOREIGN PATENT DOCUMENTS

| | | |
|---|---|---|
| DE | 18 09 316 A | 7/1969 |
| EP | 0 687 530 | 12/1995 |

* cited by examiner

*Primary Examiner*—Boyer D. Ashley
(74) *Attorney, Agent, or Firm*—Herbert Dubno; Andrew Wilford

(57) ABSTRACT

A utility knife has a flat blade formed with at least one throughgoing hole, a housing member forming a seat adapted to receive the blade, and a retainer member engageable with the blade on the seat. A pair of respective pivot elements on the housing and retainer members allow pivoting of the retainer member between a closed position engaging the blade and holding it against the seat and an open position exposing the blade and permitting its removal from the seat. Respective threadedly interengageable holding elements including a threaded screw on one of the members extending through the hole of the blade and a nut on the other of the members secure the retainer member in the closed position. The threaded screw is fixed in the housing member and has a threaded shaft projecting up from the seat. The nut is rotatable on the retainer member. The retainer member is formed with a large-diameter recess receiving the nut with radial play.

14 Claims, 5 Drawing Sheets

UTILITY KNIFE WITH SCREW-DOWN PIVOTAL BLADE CLAMP

FIELD OF THE INVENTION

The present invention relates to a utility knife. More particularly this invention concerns such a knife that holds a disposable razor-type blade by means of a pivotal retainer element.

BACKGROUND OF THE INVENTION

A utility knife such as described in European patent 0,687,530 of H. Knoop has a housing adapted to be held in the hand and having one end formed with a seat in which a standard isosceles-trapezoidal blade fits with its point projecting from an end of the housing. A cover or retainer pivoted on the housing is movable between a closed position engaging over the blade and holding it tightly against the housing in the seat and an open position permitting the blade to be removed from the seat for replacement or reversal. A spring between the retainer and the housing pops the retainer open when the latch is released, simplifying blade changing or reversal. Another hinged part acts as a latch to hold the retainer in the closed position and is positioned such that during normal use it will not move out of the latched position.

U.S. Pat. No. 5,797,188 of Gilbert discloses a similar such utility knife where instead of a hinged latch, the retainer carries offset from its pivot axis a large-diameter wheel having a threaded shaft that fits into a threaded hole in the housing. This wheel can be rotated to screw its threaded shaft into the hole and thereby solidly secure the retainer to the side of the housing, holding the blade in its seat, and can be unscrewed to free the retainer and allow the blade to be replaced or reversed.

Both of these knives have to be made to relatively tight tolerances to ensure that the parts latch together properly. This is particularly true for the screw-type retainer which must fit together perfectly coaxially to function. Furthermore neither knife holds the retainer so tightly that it cannot be pried open at the front end, for example when cutting with considerable lateral force, so that the blade can come loose or the knife can be damaged.

OBJECTS OF THE INVENTION

It is therefore an object of the present invention to provide an improved utility knife.

Another object is the provision of such an improved utility knife which overcomes the above-given disadvantages, that is which is of simple and inexpensive construction yet which very solidly holds its blade.

SUMMARY OF THE INVENTION

A utility knife has according to the invention a flat blade formed with at least one throughgoing hole, a housing member forming a seat adapted to receive the blade, and a retainer member engageable with the blade on the seat. A pair of respective pivot elements on the housing and retainer members allow pivoting of the retainer member between a closed position engaging the blade and holding it against the seat and an open position exposing the blade and permitting its removal from the seat. Respective threadedly interengageable holding elements including a threaded screw on one of the members extending through the hole of the blade and a nut on the other of the members secure the retainer member in the closed position.

Thus with this system the screw engaging right through the blade ensures that there is no significant lever action on the retainer member when the knife is used for rough cutting, for instance opening a bag. The blade is solidly held in place, yet can be changed easily simply by unscrewing the nut and screw from each other so the retainer member can be lifted to the open position.

According to the invention the threaded screw is fixed in the housing member and has a threaded shaft projecting up from the seat. The nut is rotatable on the retainer member. The retainer member is formed with a large-diameter recess receiving the nut with radial play. Thus even if the parts do not line up perfectly, the nut can be threaded on the screw. The knife does therefore not have to be made to tight tolerances.

The retainer member in accordance with the invention is formed with a stepped bore aligned in the closed position with the shaft of the screw and having an outer small-diameter portion and an inner large-diameter portion lying in the closed position between the outer portion and the blade. The nut has an internally threaded stem loosely received in the stepped bore and having an inner end with an outwardly projecting ridge of a diameter slightly greater than an inner diameter of the outer small-diameter stepped-bore portion so that the nut is captured by the stem on the retainer member. The nut can therefore move axially and radially of the axis of the screw, and can also tip somewhat relative to this axis to ensure easy fitting together of the nut and screw when the retainer is closed.

The pivot includes a pin fixed on one of the members and defining a pivot axis and a formation on the other of the members engaged around the pin. In accordance with the invention the formation engages with radial play relative to the pivot axis around the pin so that the retainer member can move limitedly radially of the pivot axis relative to the housing member. This also ensures that, even if the retainer and housing do not fit together perfectly, the nut and screw, which are normally made of metal while the rest of the structure is molded of plastic, will be able to align and fit together perfectly. The pivot axis can be transverse or parallel to the housing member.

In accordance with the invention a spring is provided on the housing member for biasing the retainer member into the open position. This spring is a coil compression spring having an inner end fixed to the housing member and an outer end engageable with the retainer member. A screw seated in the housing member has a head pressing the spring inner end against the seat and extends through the housing member and into a cover plate in which the screw is seated.

The seat is recessed in housing member and the retainer member is set generally flush in the housing member in the closed position. The blade has a pair of holes through one of which the screw engages. The seat is formed with a centering bump engaging in the other of the holes.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
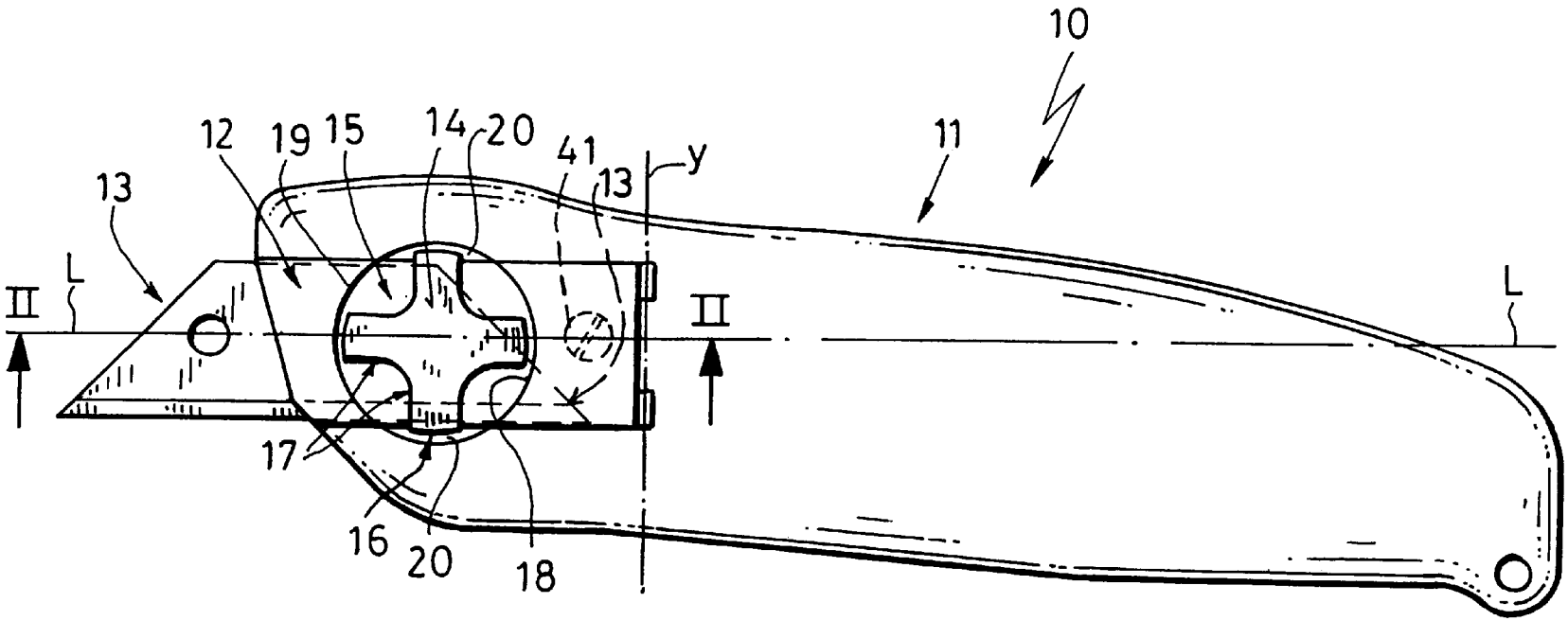
FIG. 1 is a side view of the knife according to the invention.

As seen in FIG. 1 a knife 10 according to the invention has a plastic housing or handle 11 carrying a plastic retainer 12 pivotal about an axis y transverse to a longitudinal centerline L of the handle 11. The retainer 12 holds a standard isosceles-trapezoidal blade 13 against a surface 46 of a blade seat 21, with an edge and point of the blade 13 projecting from a front end of the housing 11. A bump 23 on the surface 46 fits through a front hole 22 in the blade 13 to prevent it from moving longitudinally when pressed against the surface by the retainer 12.

Figure 4:
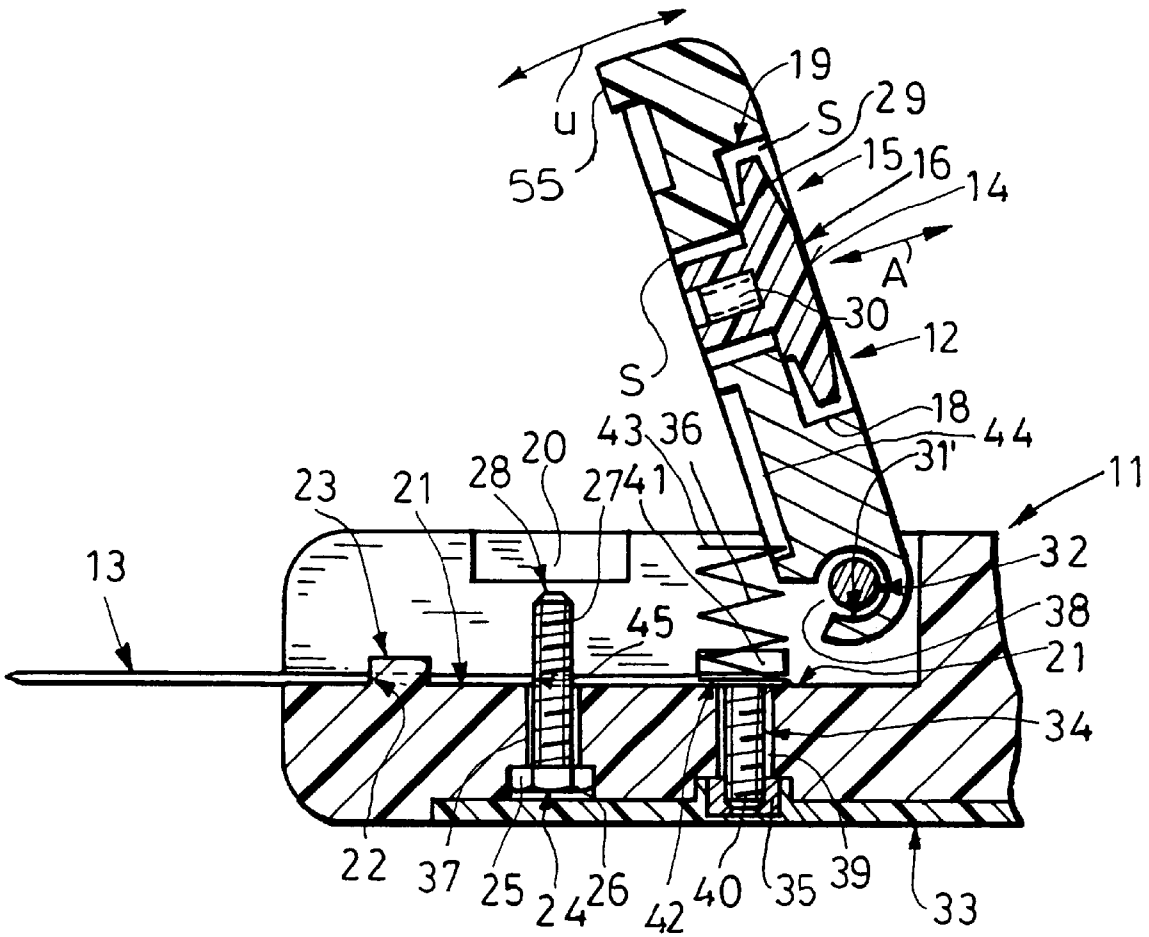
FIG. 4 is a view like FIG. 3 of a variation on the knife in accordance with the invention.
Figure 5:
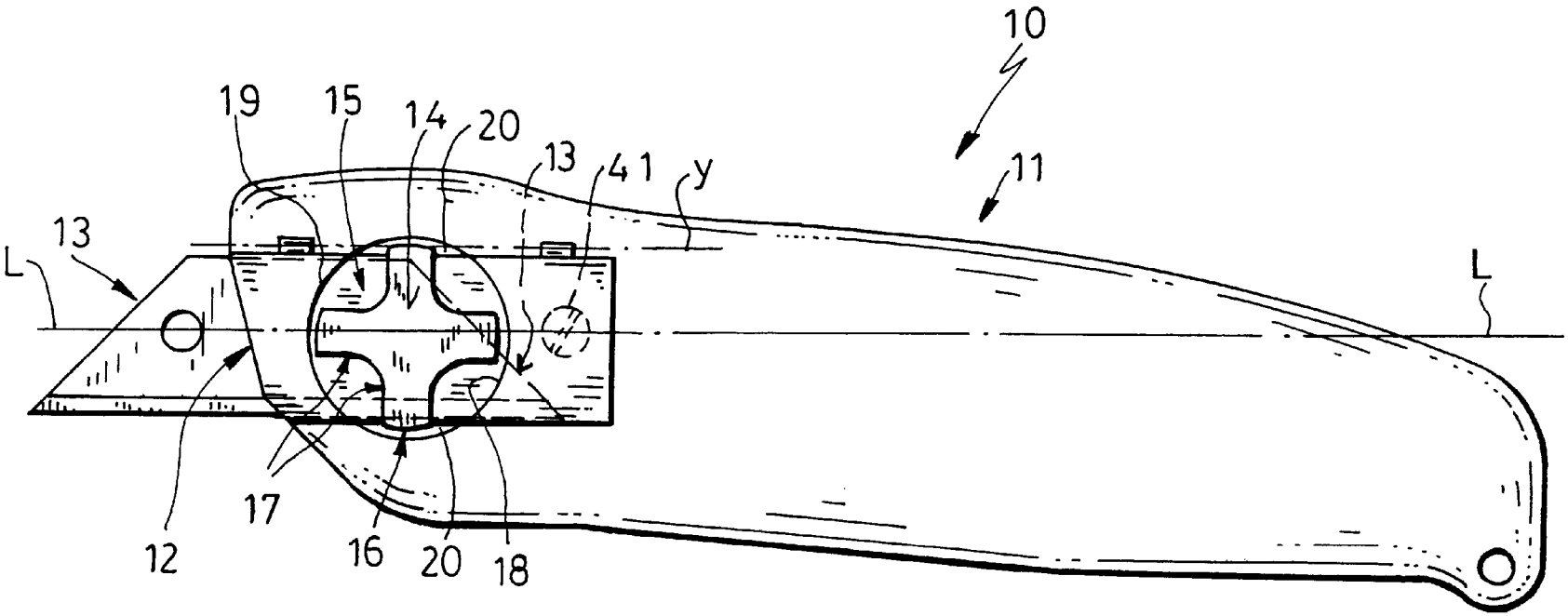
FIG. 5 is a view like FIG. 1 of another variation on the knife according to the invention.

The rear end of the retainer 12 is formed at the axis y with a cylindrical seat or slot 31 open laterally at 38 and receiving a pivot pin 32 that is set in the handle 11 and that can be a separate metal piece or unitarily formed with the retainer 12. As shown in FIG. 5 the axis y can, instead, run parallel to the longitudinal axis L, the knife 10 otherwise being identical. FIG. 4 also shows that the seat 31' can be of somewhat larger inside diameter than the outside diameter of the pivot pin 32 while the slot 38 is still of a width smaller than the diameter of this pin 32 so that the retainer 12 can move limitedly relative to the axis y but is still captured on the handle/housing 11.

The retainer 12 is held in place by a plastic nut 15 having an outer surface 14 formed with an X-shaped raised formation 16 providing finger-gripping recesses 17. This nut 15 is received in a cylindrical large-diameter recess 18 formed in the retainer 12 and in a pair of confronting part-cylindrical cutouts 20 formed in the housing 10, since the nut 15 is of a diameter that is greater than a width of the retainer 12. A pair of bumps 55 spaced apart crosswise of the axis L at a front end of the retainer 12 bear downward on the blade 13.

A screw 24 has a hex head 25 countersunk in a complementary recess 26 of the handle 11 and a threaded shaft 27 engaged through a hole 37 of the handle 11 with a threaded free end 28 exposed and projecting through a rear hole 45 in the blade 13 so as also to hold the blade 13 longitudinally. The nut 15 has a stem 29 which extends through a stepped bore 19 of the retainer 12 and in which is coaxially fitted an internally threaded metal sleeve 30 that is complementary to the threaded shaft end 28 so that it can be threaded thereto.

Figure 2A:
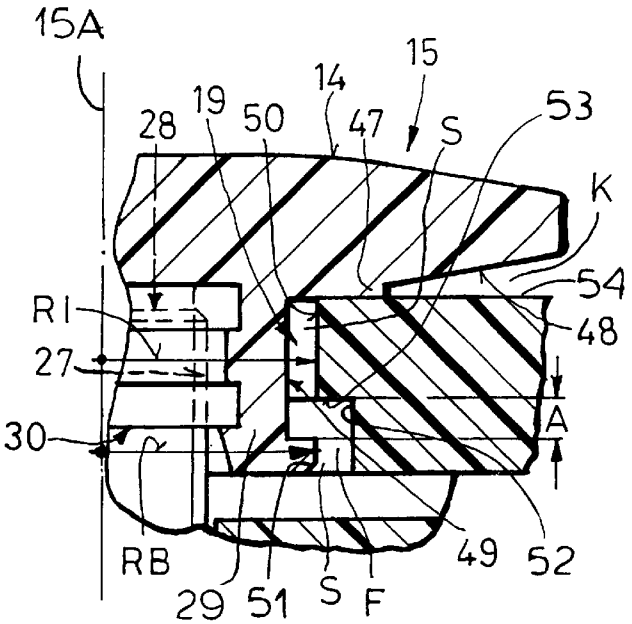
FIG. 2A is a large-scale view of the detail indicated at IIA in FIG. 2.

The nut 15 is received in the handle 11 and retainer 12 with all-around radial play S and axial play A. To this end as best shown in FIG. 2A a cylindrical outer surface 49 of the nut stem 29 has a diameter that is smaller than an inside diameter R1 of an upper portion 50 of the stepped bore 19 by the play S. The stem 29 has at its inner end a radially outwardly projecting ridge 51 of an outside diameter RB slightly greater than R1 so as to form a space F of the play S with an inner portion 52 of the bore 19. The ridge 51 has an axial height that is less by the play A than the spacing to a shoulder 53 lying between the portions 51 and 52. Thus the nut 15 can be installed in the retainer 12 by forcing its ridge 51 down through the stepped bore 19, where it will be captured. Alternately a snap ring or similar structure could be used to capture the nut 15 in the retainer 12. FIG. 2A also shows how the nut 15 has an inner portion 47 that engages a planar floor 54 of the recess 18 and an outer portion 48 of outwardly frustoconically flaring shape so as to form a space K. Thus the entire nut 15 can rock somewhat about its axis 15A.

Figure 2:
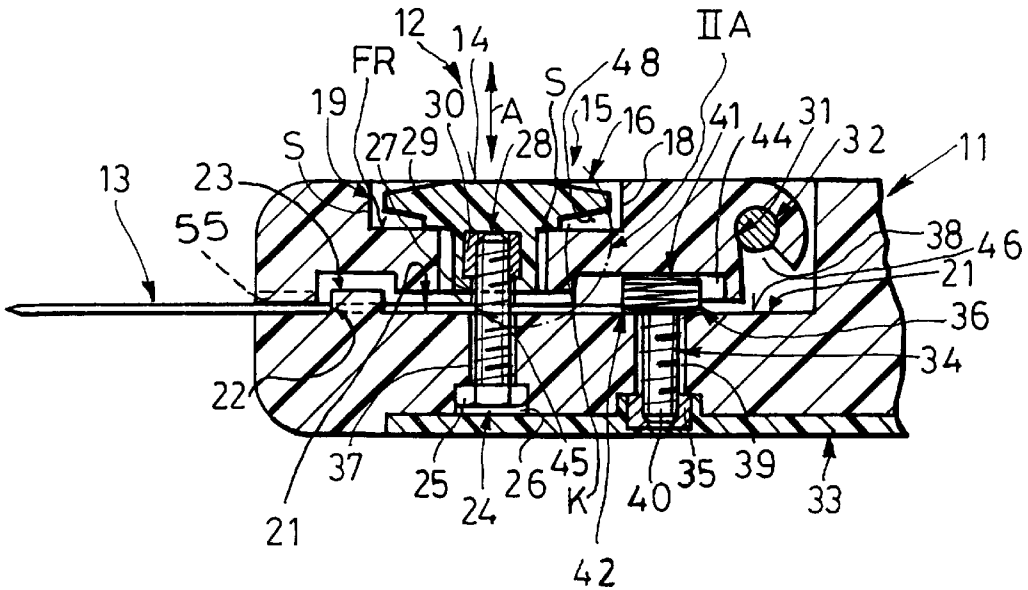
FIG. 2 is a larger-scale section taken along line II—II of FIG. 1.

As best shown in FIG. 2 a coil compression spring 36 has an inner end 42 secured under a head 41 of a bolt 34 extending through a hole 39 in the handle 11 and having a threaded end 40 received in a metallic threaded cup 35 set in a plastic bottom cover 33 of the handle 11. This spring 36 fits in the FIG. 2 closed position of the structure in a seat or recess 44 on the underside of the retainer 12 and has an upper end 43 that bears on the roof of the recess 44 and serves to push the retainer 12 into the open position of FIG. 3 when the latch formed by the nut 15 and screw 24 is released.

Figure 3:
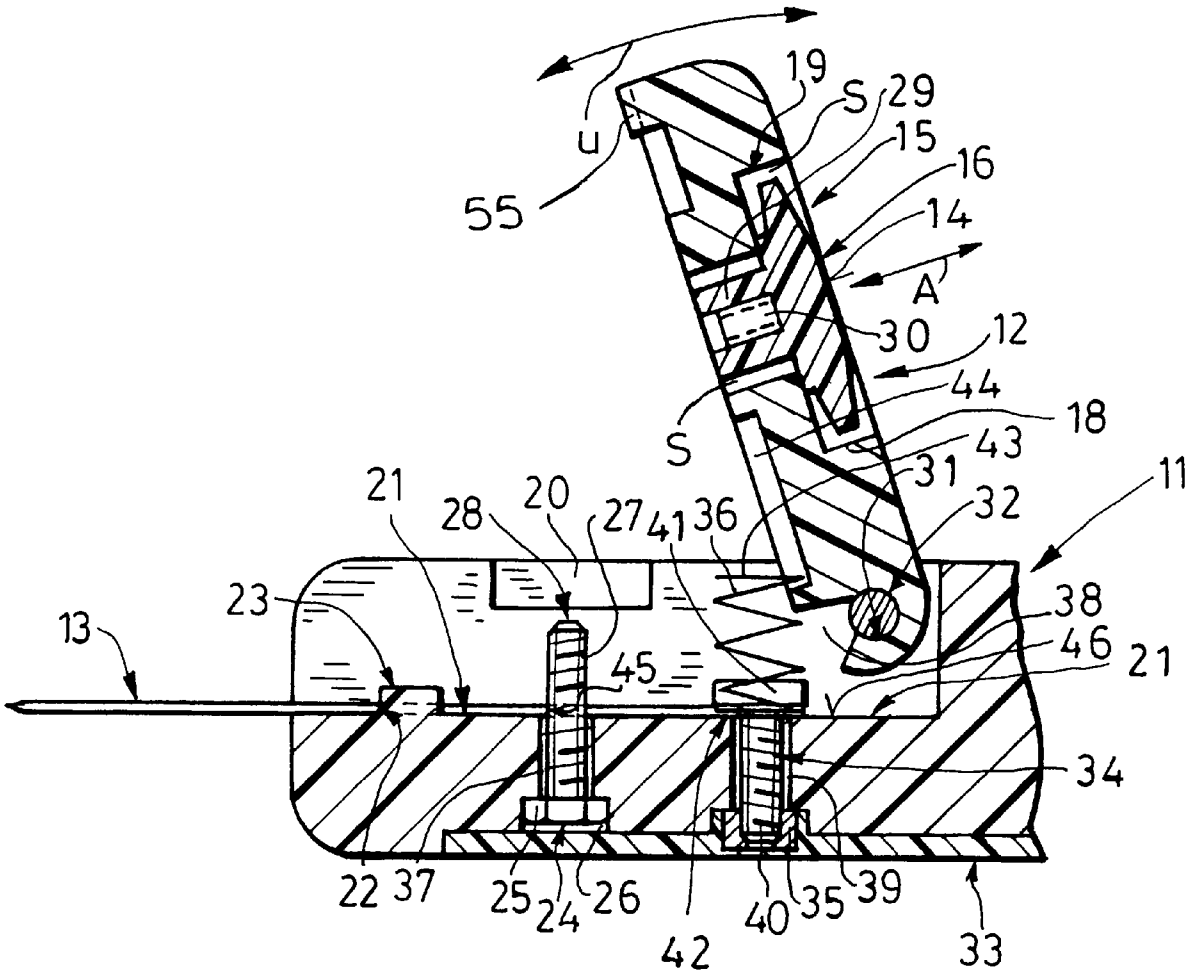
FIG. 3 is a view like FIG. 2 but with the blade retainer open.

Thus with this system the nut 15 can be unscrewed to allow the spring 36 to push the retainer 12 up as indicated by arrow u into the open position of FIG. 3. In this position the blade 13 can be removed and then replaced or reversed. The new or reversed blade 13 is set back down with the screw 24 engaging through its back hole 45 and the centering bump 23 engaged through its front hole 22, and the retainer 12 is pivoted back down into the closed position of FIG. 2. In this position the nut 15 is fitted over the screw end 28 and is rotated by the formations 17 until tight. Since the screw 24 engages right through the blade 13, this blade 13 is held very tightly and can be counted on not to move during use.

I claim:

1. A utility knife comprising:

a flat blade formed with at least one throughgoing hole;

an elongated housing member forming a handle having a seat adapted to receive the blade and lying generally parallel to a broad side of the handle;

a retainer member engageable with the blade on the seat and adapted to press said blade over a face thereof in contact with said seat thereagainst;

pivot means including a pair of respective pivot elements on the housing and retainer members for pivoting of the retainer member between a closed position engaging the blade and holding it against the seat and an open position exposing the blade and permitting its removal from the seat, the pivot means including a pin fixed on one of the members and defining a pivot axis parallel to said seat and said broad faces, and a formation on the other of the members engaged around the pin; and retaining means including a pair of respective threadedly interengageable holding elements including a threaded screw on one of the members extending through the hole of the blade and a nut on the other of the members for securing the retainer member in the closed position.

2. The utility knife defined in claim 1 wherein the formation engages with radial play relative to the pivot axis around the pin, whereby the retainer member moves limitedly radially of the pivot axis relative to the housing member.

3. The utility knife defined in claim 1 wherein the housing member is elongated and the pivot axis is transverse to the housing member.

4. The utility knife defined in claim 1 wherein the housing and retainer members are plastic.

5. The utility knife defined in claim 1 wherein the seat is recessed and the retainer member is set generally flush in the housing member in the closed position.

6. The utility knife defined in claim 1 wherein the blade has a pair of holes through one of which the screw engages, the seat being formed with a centering bump engaging in the other of the holes.

7. The utility knife defined in claim 1 wherein the threaded screw is fixed in the housing member and has a threaded shaft projecting up from the seat, the nut being rotatable on the retainer member.

8. The utility knife defined in claim 7 wherein the retainer member is formed with a large-diameter recess receiving the nut with radial play.

9. The utility knife defined in claim 7 wherein the retainer member is formed with a stepped bore aligned in the closed position with the shaft of the screw and having an outer small-diameter portion and an inner large-diameter portion lying in the closed position between the outer portion and the blade, the nut having an internally threaded stem loosely received in the stepped bore and having an inner end with an outwardly projecting ridge of a diameter slightly greater than an inner diameter of the outer small-diameter stepped-bore portion, whereby the nut is captured by the stem on the retainer member.

10. The utility knife defined in claim 1, further comprising spring means on the housing member for biasing the retainer member into the open position.

11. The utility knife defined in claim 10 wherein the spring means includes a coil compression spring having an inner end fixed to the housing member and an outer end engageable with the retainer member.

12. The utility knife defined in claim 11 wherein the spring means further includes a screw seated in the housing member and having a head pressing the spring inner end against the seat.

13. The utility knife defined in claim 12 wherein the screw extends through the housing member and the housing member includes a cover plate in which the screw is seated.

14. A utility knife comprising:

an elongated generally flat handle having a recess at one end with a flat seat parallel to a broad side of said handle;

a flat blade in said recess lying against said seat and having a hole;

a screw extending upwardly through said hole from said seat;

a retainer in said recess pivotally mounted on said handle by a pivot member to swing about an axis parallel to said seat and said broad side for pressing said blade against said seat;

a nut member received in a bore in said retainer, threaded onto said screw and bearing on said retainer for clamping said retainer against said blade and said blade against said seat; and means providing radial play for at least one of said members to ensure tight retention of said blade between the retainer and the seat.

* * * * *